United States Patent [19]

Nelson

[11] Patent Number: 4,878,374

[45] Date of Patent: Nov. 7, 1989

[54] FIVE BAR LINKAGE MECHANISM

[76] Inventor: Richard E. Nelson, 53 E. Tacoma, Clawson, Mich. 48017

[21] Appl. No.: 196,241

[22] Filed: May 20, 1988

[51] Int. Cl.[4] ..... B21J 13/00

[52] U.S. Cl. ..... 72/446; 72/455; 72/456; 100/214; 100/228

[58] Field of Search ..... 72/418, 450, 446, 448, 72/455, 456; 100/91, 214, 233, 228, 238

[56] References Cited

U.S. PATENT DOCUMENTS

| | | | |
|---|---|---|---|
| 3,154,009 | 10/1964 | Dewyer | 100/214 |
| 3,470,728 | 10/1969 | Polidori | 72/456 |
| 3,641,924 | 2/1972 | Ballard | 100/233 |
| 3,651,754 | 3/1972 | Forest | 100/91 |
| 4,329,867 | 5/1982 | Nelson | 72/455 |
| 4,580,436 | 4/1986 | Nelson | 72/446 |
| 4,580,437 | 4/1986 | Laviano | 72/450 |
| 4,643,017 | 2/1987 | Nelson | 72/455 |
| 4,706,490 | 11/1987 | Zeitlin et al. | 72/455 |

*Primary Examiner*—David Jones
*Attorney, Agent, or Firm*—Basile and Hanlon

[57] ABSTRACT

A five bar articulating mechanism having the bars pivotally linked one to another forming a closed loop. Any one of the bars is intermittently rigidly joined to an adjacent bar to convert the five bar mechanism to a four bar mechanism.

12 Claims, 1 Drawing Sheet

FIVE BAR LINKAGE MECHANISM

BACKGROUND OF THE INVENTION

I. Field of the Invention

The present invention generally relates to the field of five bar linkages and, in particular, the present invention is concerned with five bar linkages wherein any one of the bars of the linkage mechanism is intermittently rigidly joined to an adjacent bar.

II. Description of the Prior Art

Four bar linkage mechanisms are known. My U.S. Pat. No. 4,329,867 describes a press for forming complementary parts having a four bar articulating frame. In a first position the upper and lower bolster plates of the press are spaced apart in a parallel, opposed manner. When the frame is articulated from the first position to a second position, the bolster plates are in a non-parallel, nonopposed arrangement which enables the die or workpiece in the upper bolster to be approached for rework or changing from a convenient angle. While this four bar linkage mechanism provides a convenient arrangement of the bolster plates for removing finished parts and reworking or otherwise modifying the dies, the bolsters cannot be moved to a convenient position where they are non-opposed and parallel.

SUMMARY OF THE INVENTION

The present invention, which will be described in greater detail hereinafter, comprises a five bar articulating mechanism with the bars pivotally linked, one to another, forming a closed loop. One of the bars is intermittently rigidly joined to an adjacent bar which allows the mechanism to articulate in a unique manner. When this bar is rigidly joined to its adjacent bar, the mechanism acts as a four bar linkage; and when the four bar linkage reaches a limited position in its travel, this lockable link is released, allowing the mechanism to articulate further to pivot one of its links 180 degrees from its first position.

It is therefore a primary object of the present invention to provide a new and improved five bar linkage.

It is a further object of the present invention to provide a five bar linkage which has a link intermittently rigidly joined to an adjacent link.

It is also an objective of the present invention to provide a five bar linkage which, with a fifth bar rigidly joined to an adjacent link, acts like a four bar linkage.

It is yet another object of the present invention to provide a five bar linkage which, when fully articulated, has one of its links rotated 180 degrees from an original position.

It is an additional object of the present invention to provide a five bar linkage which can cross and uncross two of its links.

It is yet a further objective of the present invention to provide a five bar linkage in which, when two of its links are crossed, one of its links is opposite and opposed to another of its links.

It is yet another objective of the present invention to provide a five bar linkage in which, when two of its links have been uncrossed, one of its links is in an opposed position to another of its links and has been rotated 180 degrees from an original position.

It is yet another object of the present invention to provide a five bar linkage having a linear actuator for intermittently rigidly joining one of its links to an adjacent link.

Further objects, advantages and applications of the present invention will become apparent to those skilled in the art to which this invention pertains, when the accompanying description of one example of the best mode contemplated for practicing the invention is read in conjunction with the accompanying drawing.

BRIEF DESCRIPTION OF THE DRAWING

In the drawing, like reference numbers refer to like parts throughout the several views, and wherein.

DESCRIPTION OF THE PREFERRED EMBODIMENT

Figure 1:
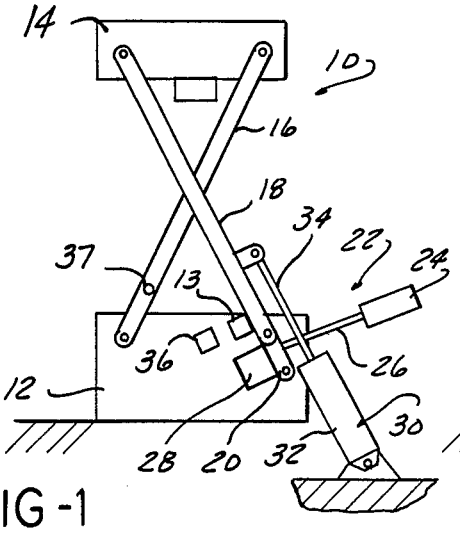
FIG. 1 illustrates a side view of the articulating five bar mechanism of the present invention.

Referring now to the drawing, there is illustrated one example of the present invention in the form of an articulating five bar mechanism 10 in FIG. 1. The five bar articulating mechanism of FIG. 1 comprises a base 12 which constitutes a first bar. A second bar 14 is spaced upward from the first bar when the five bar mechanism is in a first position as illustrated in FIG. 1. A third bar 16, when the mechanism is in the first position, is pivotally linked at a lower end to a left end of the first bar 12 and pivotally linked at an upper end to a right end of the second bar 14. A fourth bar 18, when the mechanism is in the first position, is pivotally linked at an upper end to the left end of the second bar 14 and extends downward and to the right, crossing the third bar 16, and is pivotally linked at a lower end to a second end of a fifth bar 20. The fifth bar 20 is pivotally joined at its first end to the base or first bar 12. A limiting stop 13 is abutted by the fourth bar 18 to establish the location of the mechanism in the first position.

A means 22 is provided for intermittently locking the fifth bar 20 to the first bar 12 to convert the five bar linkage mechanism into a four bar linkage mechanism. The means 22 illustrated in FIG. 1 comprises a linear actuator 24 having a rod 26 which, when extended, clamps the fifth bar 20 against a stop 28, rendering the fifth bar rigidly connected to the base or first bar 12. An actuating means 30 is provided to articulate the five bar linkage mechanism 10 from the position shown in FIG. 1 to the positions shown in FIGS. 2, 3, 4 and 5.

The means 30 for articulating the five bar linkage mechanism 10 comprises a cylinder 32 having an extendable rod 34 secured to the fourth bar 18. When the rod 34 is retracted from its position shown in FIG. 1 to its position shown in FIG. 2, the linkage mechanism 10 is articulated as shown and the third bar 16 comes against a second stop 36 which, due to the downward force of gravity, locks the third bar 16 to the first bar 12. With the rod 26 extended, the fifth bar 20 is prevented from pivoting and the mechanism acts as a four bar linkage and is extended or articulated to the extent of its allowable travel as a four bar linkage, as illustrated in FIG. 2 of the drawing.

Figure 2:
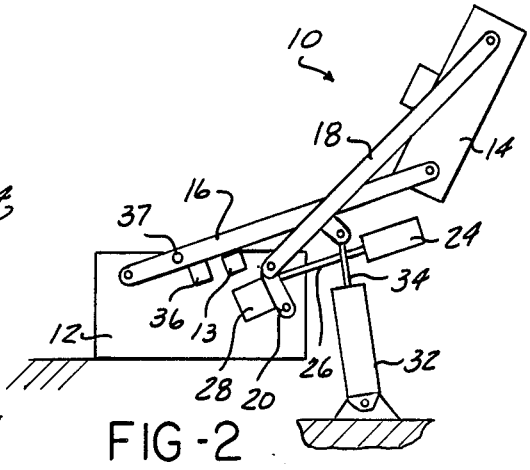
FIG. 2 illustrates the five bar articulating mechanism of FIG. 1 with the fifth bar rigidly secured to the first bar and the mechanism articulated as a four bar mechanism.

If the mechanism 10 is inverted from the position shown in FIG. 2, gravity would not be available to hold the third bar 16 against the second stop 36. In this instance, a means, such as a shot pin 37, is employed to lock third bar 16 to first bar 12 in FIGS. 2, 3 and 4.

Figure 3:
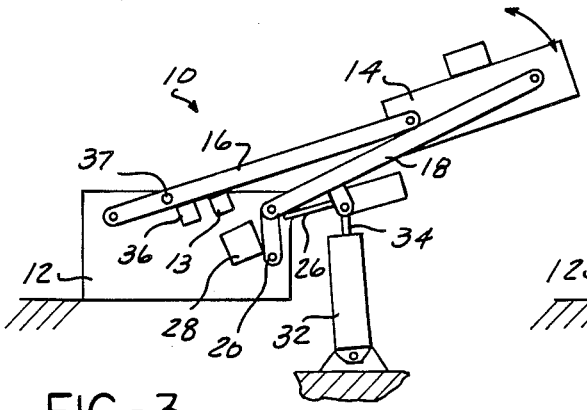
FIG. 3 illustrates the five bar mechanism of FIG. 2 with the third bar rigidly secured to the first bar and with the fifth bar released to pivot freely and the mechanism further articulated as a secondary four bar mechanism.
Figure 4:
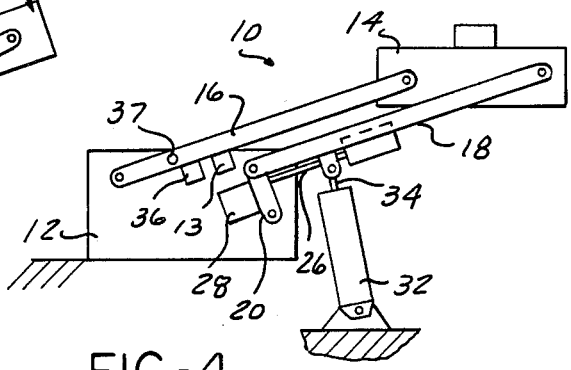
FIG. 4 illustrates said secondary four bar mechanism of FIG. 3 articulated to the extent of its allowable travel with the second bar rotated 180 degrees from its first position and the fifth bar or link rigidly secured to the first link.

In FIG. 3 of the drawing, the rod 26 is retracted, allowing the fifth bar 20 to pivot and the mechanism is then free to articulate to the position shown in FIG. 4 of the drawing. When the mechanism articulates from the position shown in FIG. 3 to the position shown in FIG. 4, the link or bar 20 comes against the stop 28 and the bar 16 remains against the second stop 36. It will be noted in FIG. 4 that the second bar 14 has been displaced to the side of the first bar or base 12 and that the second bar 14 has been rotated 180 degrees from the position shown in FIG. 1 and is now facing upward.

Figure 5:
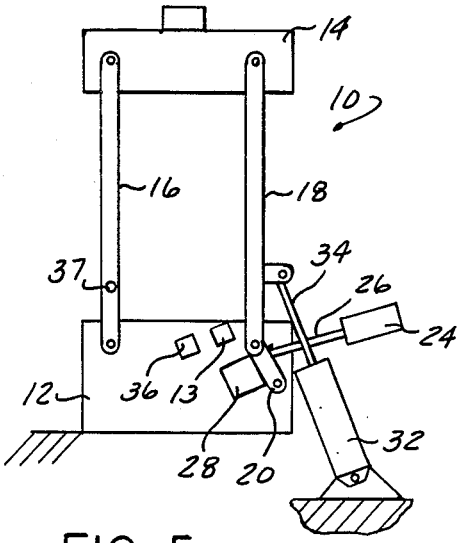
FIG. 5 illustrates the five bar mechanism articulated as a four bar linkage from the position illustrated in FIG. 4 to a new position with the second link having been rotated 180 degrees from its first position to a new position opposed to the first link.

When the linkage mechanism 10 is in the position shown in FIG. 4 and rod 26 is extended to hold fifth bar 20 against the stop 28, and second rod 34 is extended to place the linkage mechanism 10 in the position shown in FIG. 5, it will be noted that second bar 14 has been rotated 180 degrees from the position shown in FIG. 1, the third bar 16 and the fourth bar 18 have been uncrossed, and the second bar 14 is opposed to the first bar or base 12.

When the linkage mechanism 10 is in the position shown in FIG. 4 of the drawing and rod 26 is retracted to allow the fifth bar 20 to freely pivot and second rod 34 is then extended, the five bar linkage mechanism 10 will return to the original position shown in FIG. 1 of the drawing.

Figure 6:
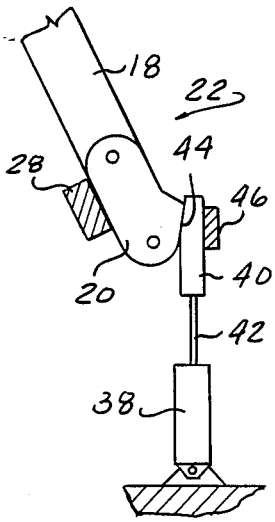
FIG. 6 illustrates a linear actuator for intermittently locking the fifth link to the first link with the actuator in a first position wherein the first link is locked to the fifth link.
Figure 7:
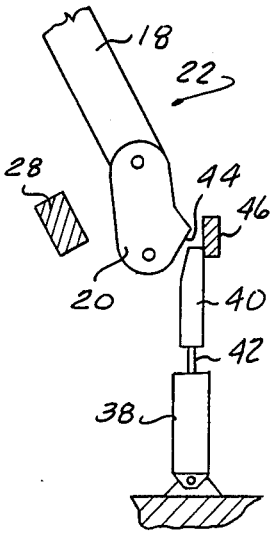
FIG. 7 illustrates the linear actuator of FIG. 6 with the actuator in a second position and the fifth link released and free to pivot.

In a preferred embodiment, the means for intermittently and selectively joining the fifth bar 20 to the first bar 12 is illustrated in FIGS. 6 and 7 of the drawing. As illustrated in FIG. 6 of the drawing, a linear actuator 38 has a rod 42 which, when extended, deploys a wedge 40 against a ramp 44 formed on the fifth bar 20. The wedging action thus produced forces the fifth bar 20 against the stop 28 to rigidly join the fifth bar 20 to the first bar 12. Support 46 prevents any sideways motion of the wedge 40 when it is engaging the ramp 44.

When the linkage mechanism 10 is articulated from the position shown in FIG. 1 to the position shown in FIG. 2, rod 26 is extended to rigidly join the fifth bar 20 to the first bar 12 and the mechanism is moved from the position shown in FIG. 1 to the position shown in FIG. 2 by retracting second rod 34. In moving from the position shown in FIG. 1 to the position shown in FIG. 2, the mechanism 10 acts as a four bar linkage. To move the mechanism from the position shown in FIG. 2 to the positions shown in FIGS. 3 and 4, rod 26 is retracted and the fifth bar 20 is allowed to freely pivot, allowing fourth bar 18 to uncross from third bar 16 and achieve the position shown in FIG. 4.

To articulate the linkage mechanism 10 from the position shown in FIG. 4 to the position shown in FIG. 1 of the drawing, rod 26 is retracted, allowing the fifth bar 20 to freely pivot, and second rod 34 is extended to articulate the mechanism 10 to the position shown in FIG. 3 and then to the position shown in FIG. 2. The rod 26 is then extended to rigidly join the fifth bar 20 to the first bar 12 and second rod 34 is further extended until the mechanism 10 is returned to the position shown in FIG. 1 of the drawing.

It can thus be seen that the present invention has provided a new and improved five bar articulating mechanism with the bars pivotally linked one to another to form a closed loop with a means for intermittently rigidly joining any one of the bars to an adjacent bar to convert the five bar articulating mechanism to a four bar articulating mechanism.

It should be understood by those skilled in the art of articulating mechanisms that other forms of the Applicant's invention may be had, all coming within the spirit of the invention and the scope of the appended claims.

Having thus described my invention, what I claim is:

1. A five bar articulating mechanism, comprising:

a base defining a first bar;

a second bar spaced upward from the first bar in a parallel opposed manner;

a third bar pivotally linked at a lower end to a left end of the first bar, and pivotally linked at an upper end to a right end of the second bar;

a fourth bar pivotally linked at an upper end to a left end of the second bar, the fourth bar extending downward and to the right, crossing the third bar;

a fifth bar pivotally linked at a first end to the first bar, and pivotally linked at a second end to a lower end of the fourth bar;

wherein the mechanism is movable from a first position wherein the second bar is spaced above and opposed to the first bar, to a second position wherein the first and second bars are in a non-parallel, non-opposed position, the mechanism further comprising:

means, acting on one of the bars, for selectively rigidly positioning the one bar non-pivotally with respect to an adjacent bar, the positioning means causing the mechanism to operate as a four bar articulating mechanism, thus stopping the mechanism at the second position, when the means positions the one bar non-pivotally, and the positioning means further causing the mechanism to operate as a five bar articulating mechanism, thus allowing the mechanism to move to a third position wherein the second bar is rotated 180° and positioned adjacent the first bar, when the means allows the one bar to pivot.

2. The five bar articulating mechanism as defined in claim 1 further comprising:

means, connected to one of the bars, for articulating the mechanism from the first position to the second position.

3. A five bar articulating mechanism comprising:

a base defining a first bar;

a second bar spaced upward from the first bar in a parallel opposed manner;

a third bar pivotally linked at a lower end to a left end of the first bar and pivotally linked at an upper end to a right end of the second bar;

a fourth bar pivotally linked at an upper end to a left end of the second bar, the fourth bar extending downward and to the right, crossing the third bar; and a fifth bar pivotally linked at a first end to the first bar, and pivotally linked at a second end to a lower end of the fourth bar;

wherein the mechanism is movable from a first position wherein the second bar is spaced above and opposed to the first bar, to a second position wherein the first and second bars are in a non-parallel, non-opposed position.

4. The five bar articulating mechanism as defined in claim 3 further comprising means, acting on the fifth bar, for selectively rigidly positioning the fifth bar non-pivotally with respect to the first bar.

5. The five bar articulating mechanism as defined in claim 4 wherein when the means positions the fifth bar non-pivotally, the mechanism articulates as a four bar mechanism and stops at the second position.

6. The five bar articulating mechanism as defined in claim 3 further comprising means, connected to the third bar, for selectively rigidly positioning the third bar non-pivotally with respect to the first bar.

7. The five bar articulating mechanism as defined in claim 6 wherein when the means positions the third bar non-pivotally, the mechanism articulates as a four bar mechanism and stops at the second position.

8. The five bar mechanism as defined in claim 4 wherein the means comprises:

a stop formed on the first bar positioned to abut the fifth bar; and a wedge carried by a linear actuator, which in a first position forces the fifth bar against the stop and, in a second position, the wedge is free of contact with the fifth bar, and the fifth bar is free to rotate away from the stop.

9. A five bar articulating mechanism comprising:

a base defining a first bar;

a second bar spaced upward from the first bar in a parallel opposed manner;

a third bar pivotally linked at a lower end to a left end of the first bar, and pivotally linked at an upper end to a right end of the second bar;

a fourth bar pivotally linked at an upper end to a left end of the second bar, the fourth bar extending downward and to the right, crossing the third bar;

a fifth bar pivotally linked at a first end to the first bar, and pivotally linked at a second end to a lower end of the fourth bar;

wherein the mechanism is movable from a first position wherein the second bar is spaced above and opposed to the first bar, to a second position wherein the first and second bars are in a non-parallel, non-opposed position, the mechanism further comprising:

means, acting on the fifth bar, for selectively rigidly positioning the fifth bar non-pivotally with respect to the first bar.

10. The mechanism as defined in claim 9 further comprising means, connected to the fourth bar, for articulating the mechanism from the first position to a third position wherein the second bar is rotated 180 degrees and positioned adjacent the first bar.

11. The mechanism as defined in claim 10 further comprising means, connected to the fourth bar, for articulating the mechanism from the third position to a fourth position wherein the second bar is rotated 180 degrees from the first position and is spaced above and opposed to the first bar.

12. The mechanism as defined in claim 9 further comprising means, connected to the third bar, for selectively rigidly positioning the third bar non-pivotally with respect to the first bar.

* * * * *